US006009678A

United States Patent [19]

Franco da Encarnação

[11] Patent Number: 6,009,678

[45] Date of Patent: Jan. 4, 2000

[54] VIRTUAL BLOCK FOR PREFABRICATION SLABS

[76] Inventor: Fernando Antonio Franco da Encarnação, Rua Leobina Periera, 38, JD. S. Paulo, Recife-PE, CEP 50 910, Pernambuco, Brazil

[21] Appl. No.: 09/032,822

[22] Filed: Mar. 2, 1998

[30] Foreign Application Priority Data

Oct. 24, 1997 [BR] Brazil ..... 000836

[51] Int. Cl.[7] ..... E04B 1/16

[52] U.S. Cl. ..... 52/327; 52/319

[58] Field of Search ..... 52/319, 327, 443

[56] References Cited

U.S. PATENT DOCUMENTS

| | | | |
|---|---|---|---|
| 1,871,318 | 8/1932 | Greenwood | 52/314 |
| 1,917,062 | 7/1933 | Reinhard | 52/314 |
| 2,775,019 | 12/1956 | Bemis | 52/314 |
| 5,685,116 | 11/1997 | Bradshaw et al. | 52/311.1 |
| 5,809,721 | 9/1998 | Antropius | 52/327 |

*Primary Examiner*—Beth Aubrey
*Attorney, Agent, or Firm*—Harrison & Egbert

[57] ABSTRACT

A virtual block for pre-fabricated slabs for replacing cement, ceramic or expanded foam blocks during the erection and finishing work of slabs having a flume with longitudinal and angled moldings. The flume is fabricated with corrugated sheets. Rib-butts are positioned at the side of the flume and are grooved so as to promote the embedding of lattice ends. The rib-butts are angled structures with shapes and external measures that are exactly equal to the internal shapes and measures of the flume in such a way that when the lattices are encased in the interior of the flume, the flume becomes structured and gains strength opposing any orthogonal forces. The lattices incorporate side expansions to indicate their orthogonality in relation to an axis of the flume. Holes are distributed in a surface of the lattices.

2 Claims, 3 Drawing Sheets

VIRTUAL BLOCK FOR PREFABRICATION SLABS

TECHNICAL FIELD

The present invention relates to prefabricated slabs as used in the construction of floors and roofs. More particularly, the present invention relates to prefabricated slabs having a sets of ribs and blocks.

BACKGROUND ART

The system of pre-fabricated slabs is one of the most widely used in civil construction of slabs to be used in floors and roofs. The pre-fabricated slabs include a set of ribs (slabs with reinforced concrete rods which gives structure and strength to the slab), and the blocks (hollow units that are placed as a supporting base for the fresh concrete which is tamped in the top section) that, different from the ribs have no structural function and it is just a dead load (weight due to the mass itself placed on the structure). In all, ribs and blocks a layer of concrete is placed and tamped. The work required to place the blocks between the small beams is a time consuming task, hazardous and arduous. The blocks have no structural function, but become a support for the concrete (while it is fresh) poured on the top of the slab, and the lower face acts to support the finishing mortar for the stucco and ceiling finishing work.

Recently, the use of the expanded foam blocks have been used to replace concrete or ceramic blocks. This technique diminished work accidents due to the fall of blocks as well as the worthless load put on the slabs due to the mass weight of the blocks. However, since the expanded foam blocks compact and are fragile they call for additional handling care as regard to bracing, the motion of workmen or the top of the structure at the time of pouring, excavation or cut to suit work to make way for ducts and conduits along the blocks. Furthermore, the expanded foam blocks impair the placing of switches and finishing work using gypsum plates finishing work due to low strength and the absence of hang spots to support the plates, thus requiring additional work to overcome these shortcomings.

SUMMARY OF THE INVENTION

To eliminate such shortcomings a pre-fabricated slab virtual block was developed to replace the conventional blocks once for all, as well as expanded foam blocks in the erection to pave the way for the concreting of pre-fabricated slabs.

The replacement of the conventional blocks is made by flumes with structural partitions already encasing. The assembly incorporates an exceptional stability and strengthening to the flume, thus facilitating the direct pouring of concrete without any bracing devices, except where the ones required by the beams framework for the arching of the ribs.

The inside area of the flumes could be used as a passage for ducts, pipes, placing of switch boxes, reactors and light switches, bases for chandeliers, and others. The structure of the partitions can be used as a supporting base for the conventional gypsum ceiling or to encasing ornamental plaques or structural ones, to facilitate mortar finishing work on the inferior surface of the slabs.

The invention can be better understood by the drawing references which integrates this report.

BRIEF DESCRIPTION OF THE DRAWINGS

FIG. 2 further shows the feasibility of manufacturing the flumes with corrugated sheets.

FIG. 4 further shows the holes (6) which can be used for bracing of switch boxes, crossbars, loops for ducts supporting, pipes, etc. FIG. 4 further shows that the ends of the lattice (4) are wedge shaped to be embedded under pressure into the rib-butts (3) placed at flume (1) side wall.

DETAILED DESCRIPTION OF THE INVENTION

Figure 1:
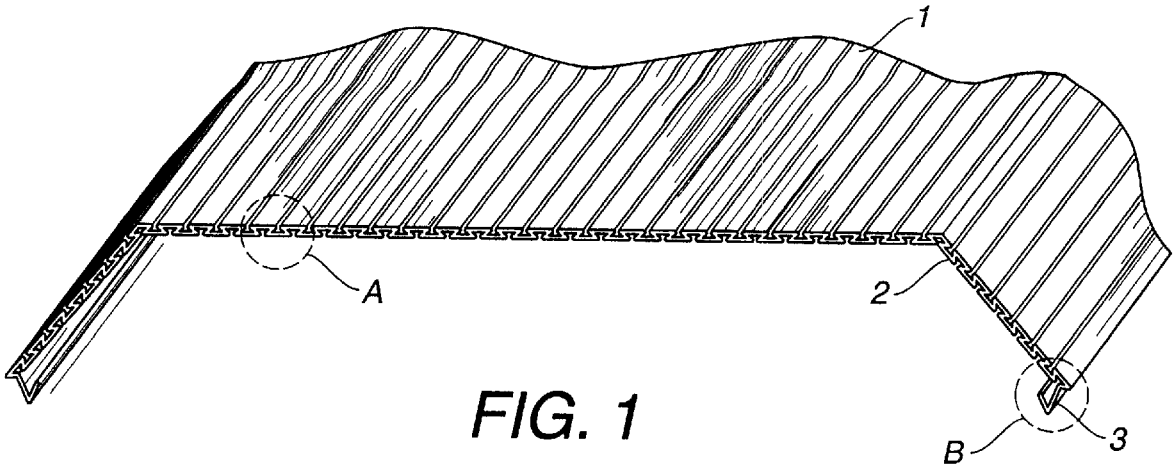
FIG. 1 is a representative view of the flume (1) and standing out the mouldings (2) and the rib-bults (3) and the side of the flume (1).
Figure 2:
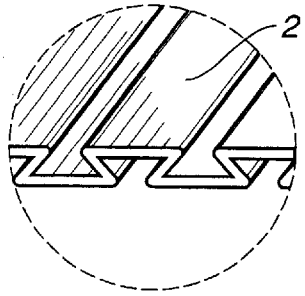
FIG. 2 is an enlarged view of circled area B of FIG. 1 showing the rib-butt at the side of the flume of the mouldings to show that they have angle sides to generate concrete adherence.
Figure 3:
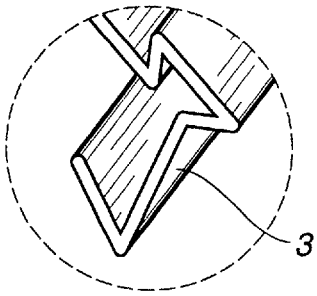
FIG. 3 is an enlarged view of the groove (3) to show lattice encasing of rib butts.
Figure 4:
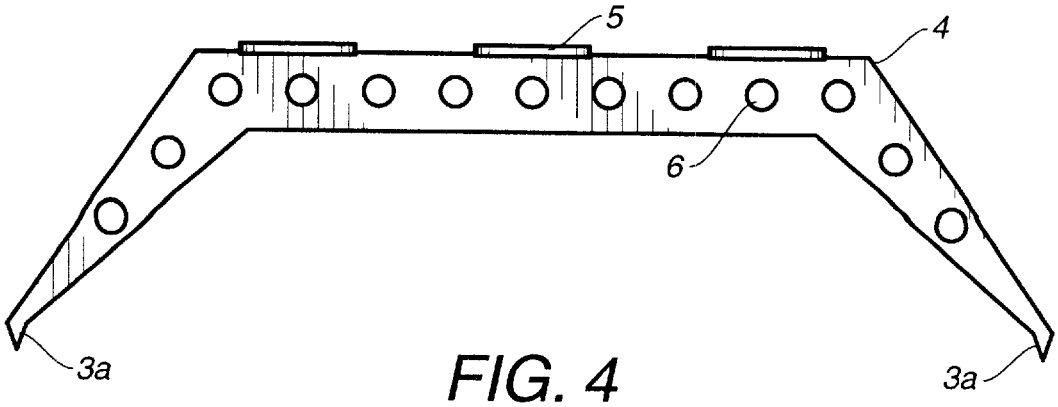
FIG. 4 is a side view of the lattice (4) where the lateral expansions (5) define the orthogonality of the lattice (4) in relation to flume (1).
Figure 5:
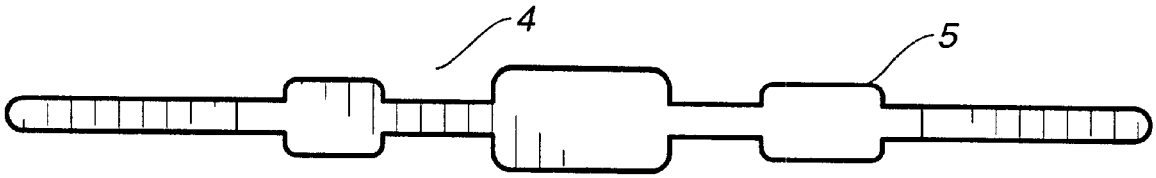
FIG. 5 is a top view of the upper part of the lattice (4) to distinguish the lateral expansion (5) at the lattice top part.
Figure 6:
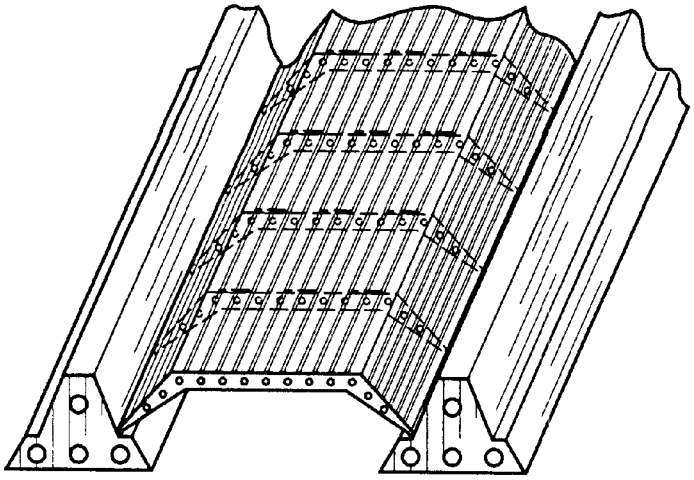
FIG. 6 shows the exact position of the flume (1) in relation to the ribs prior to concrete pouring.

In the present invention, the virtual blocks for prefabricated slabs is intended to replace cement, ceramic or expanded foam blocks during the erection and finishing work of slabs, in flooring, or in roofing. The slabs include a flume (1) with longitudinal and angled mouldings. The flume (1) is placed outwardly so as to create conditions for concrete adherence or inwardly as a retention line and decorative element. The flume (1) can also be placed in both sides. The flume is fabricated with corrugated sheets so as to achieve the aforementioned affects. The rib-butts (3) at the sides of the flume (1) are formed in a way so as to enhance the embedment of the ends **(3*a*) of lattice (4). The ends (3*a*) are angled structures which have a shape and a measurement which is exactly equal to the internal shape and measurement of the rib-butts (3) of flume (1). As such, the lattices (4) are encased in the interior of the flume (1). The flume (1) has structure and gains strength which opposes the orthogonal forces, such as the concrete mass or the trampling on the top of the slab. The lattices (4) incorporate side expansions (5) to provide their orthogonality in relation to the axis of the flume (1). Holes (6)** are distributed in an orderly manner on the entire surface so as to be used for the encasing of pre-fabricated structures.

The flume (1) incorporates angled mouldings (2) so as to provide concrete adherence. When the flume (1) is manufactured with corrugated sheets, mouldings (2) are formed at both sides of the flume (1). The internal mouldings (2) can be used as a retention line for pre-fabricated support saddles for tubes, ducts, etc. The external mouldings (1) can be used for the encasing of the wedges for filling the gaps (if any) of the mouldings.

The lattices (4) are fitted, under pressure, in the interior of the flume (1). After the concreting work has occurred, these lattices can be taken out and used again in another construction activity. The lattices incorporate holes (6) evenly distributed thereabout in a manner so as to allow for the exact encasing of fitting or lighting boxes, muffles, fans, supporting film cameras, etc. The rib-butts (3*a*) of the flume (1) can be used as a support for the retention of functional structures or ornamental products. These rib-butts (3) can also be used for ceiling finishing such as amianthus cement for mortar or gypsum plates for finishing mortar.

The present invention is made of a flume and a pre-fabricated lattice system which completely replaces the use of cement, ceramic, or expanded cement blocks used among the mouldings in pre-fabricated slabs. The system of flumes facilitates the erection for concreting, finishing and electrical and hydraulic installation, and fire systems. This system of flume can also be used as finishing work itself if it is left with a coating of the bottom surface in the mould spacing. The lattices can be taken out since they are simply embedded upon the flume. As such, the lattices can be used for subsequent work. If they are left within the flume, then they can be used for supporting ceiling gypsum sheets, or supporting switch boxes, ducts, pipes, and other parts.

The erection of the flume (1) comprises placing of the lattices (4) in the interior of same, taking care that the butts of the lattice (4) are firmly embedded at the side rib-butts in a way to produce firmness and strengthening of flume (1).

Spacing among lattices (4) should be made as per the thickness of concrete to be placed at the top part of the slab.

Figure 7:
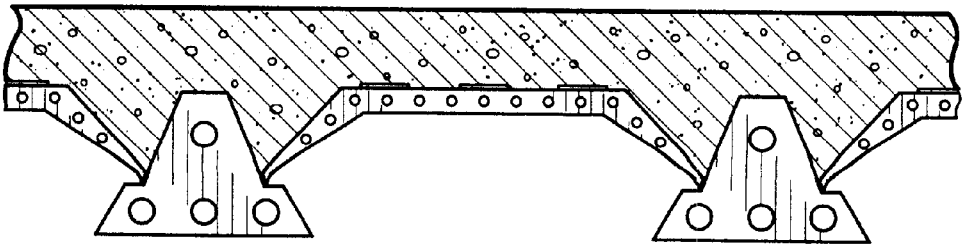
FIG. 7 shows a top view in a perpendicular cross-section cut of the ribs after the pouring of the concrete.
Figure 8:
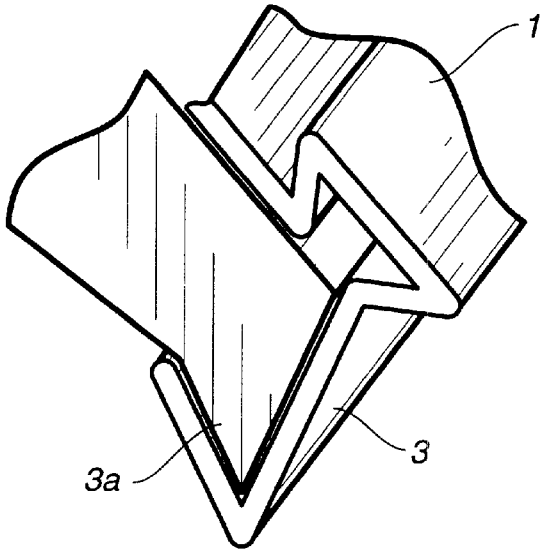
FIG. 8 is a detailed view showing how the rib-butt of the flume receives the end of the lattice.
Figure 9:
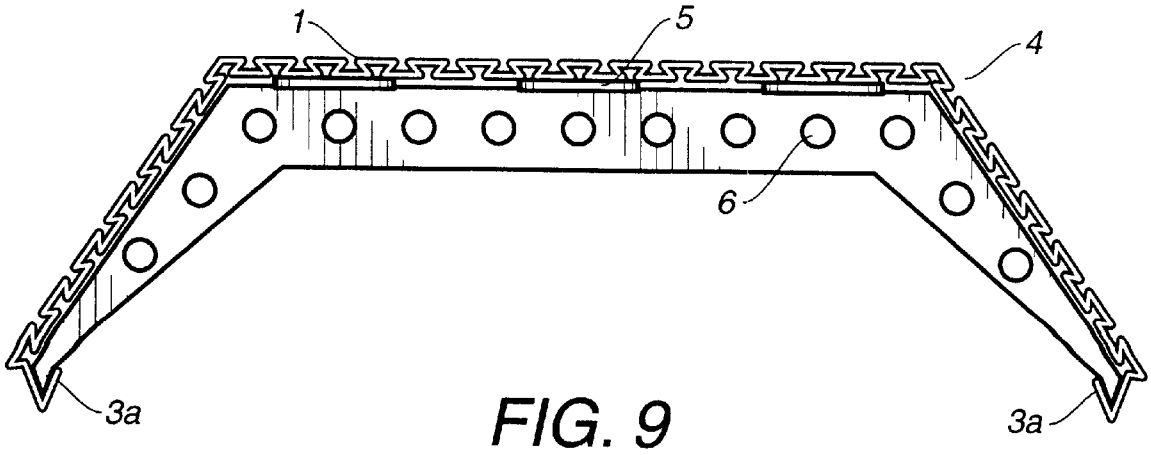
FIG. 9 is an end view showing how the flume is secured onto the lattice.

After the embedding of the lattices, the flume is ready to be used, and just place it among the ribs with the opening facing down. Adjust the ribs at the side of the flume (1) and start concrete pouring at once. FIG. 7 shows a top view in a perpendicular cross-section cut showing the ribs after concreting work.

The innovative source used in the invention results in less labor in the erection of the system, decreases the time required for the assembly and decreases accidents, providing more efficiency and time saving, as well as energy, and replacement of parts thus reducing operational costs and materials at the site.

This innovative invention is a useful tool, simple, functional and efficient, easy to assembly and disassembly very fast. It is a part easily manufactured and fitted for any type of civil works where pre-fabricated slabs are used.

The virtual block for pre-fabricated slabs further to fabrication and operational advantages offered, it is marked with characteristics to comply with qualification of an innovative device, thus conciliating every and all conditions to deserve the prerrogative of an invention patent, whose criterion of the new patent laws are perfectly met, and combines well known elements resulting in a new and complete form for efficient utilisation, bringing advantages up until then unusual.

I claim:

1. A virtual block for pre-fabricated slabs for replacing cement, ceramic or expanded form blocks in erection and finishing work of slabs, of floors or of roofing, the virtual block comprising a flume with longitudinal and angular moldings, the flume being fabricated of corrugated sheets, said flume having rib-butts that are formed to embed respective ends of a lattice, said ends are angled structures with a shape and size that are exactly equal to an internal shape and size of the rib-butts of the flume in such a way that the lattice is encased in an interior of the flume such that said flume becomes structured and gains strength to oppose orthogonal forces, the lattice having holes formed and distributed on a surface of the lattice.

2. The virtual block for the pre-fabricated slabs as per claim 1, wherein said lattice is fitted under pressure in an interior of the flume.

* * * * *